United States Patent [19]

Horner

[11] Patent Number: 4,840,493

[45] Date of Patent: Jun. 20, 1989

[54] MOTIONLESS MIXERS AND BAFFLES

[76] Inventor: Terry A. Horner, 143 S. Main, Allenstown, N.J. 08514

[21] Appl. No.: 121,935

[22] Filed: Nov. 18, 1987

[51] Int. Cl.[4] ..... B01F 5/06

[52] U.S. Cl. ..... 366/339; 138/42; 366/338

[58] Field of Search ..... 366/336–340, 366/176, 341; 138/38, 40, 42; 137/896

[56] References Cited

U.S. PATENT DOCUMENTS

| | | | |
|---|---|---|---|
| 3,620,506 | 11/1971 | So . | |
| 3,643,927 | 2/1972 | Crouch . | |
| 3,652,061 | 3/1972 | Chisholm . | |
| 3,664,638 | 5/1972 | Grout et al. . | |
| 3,704,006 | 11/1972 | Grout et al. . | |
| 3,733,057 | 5/1973 | Kahoun . | |
| 3,794,300 | 2/1974 | Harder . | |
| 3,827,888 | 8/1974 | Terwilliger et al. . | |
| 3,893,654 | 7/1975 | Miura et al. . | |
| 3,923,288 | 12/1975 | King . | |
| 4,034,965 | 7/1977 | King . | |
| 4,164,375 | 8/1979 | Allen . | |
| 4,179,222 | 12/1979 | Strom et al. . | |
| 4,211,277 | 7/1980 | Grosz-Roll et al. . | |
| 4,220,416 | 9/1980 | Branner et al. . | |
| 4,222,672 | 9/1980 | Shaw . | |
| 4,408,893 | 10/1983 | Rice, III | 366/339 |
| 4,522,504 | 6/1985 | Greverath | 366/339 |
| 4,538,920 | 9/1985 | Drake | 366/339 |

FOREIGN PATENT DOCUMENTS

| | | | |
|---|---|---|---|
| 83/01395 | 4/1983 | PCT Int'l Appl. | 366/338 |

*Primary Examiner*—Timothy F. Simone

*Attorney, Agent, or Firm*—Davis, Bujold & Streck

[57] ABSTRACT

The invention relates to motionless mixers and baffles thereof and includes a baffle having a pair of substantially symmetric opposing major surfaces generally helically twisted along a central longitudinal axis of the baffle and a first substantially planar surface connecting the pair of major surfaces at one end of the baffle, the first planar surface extending both substantially transversely and substntially parallel to the central longitudinal axis. The intersection of the first planar surface and one of the major surfaces forms a knife-like edge at the one end of the baffle. Similar additional knife-like edges can be provided, a second knife-like edge on the one end of the baffle radially disposed on opposite sides of each of a pair of axes through a central longitudinal axis of the baffle to form leading edges of the baffle and a like pair of knife-like trailing edges on an opposite end of the baffle. Such geometry enables a plurality of the baffles to be formed as a single insert unit by conventional injection molding techniques using only a pair of mold halves.

20 Claims, 2 Drawing Sheets

MOTIONLESS MIXERS AND BAFFLES

FIELD OF THE INVENTION

The present invention relates to in-line motionless mixing devices for intermixing a plurality of fluids generally referred to as motionless mixers, and, in particular, to the types of such devices employing successive and alternating right- and left-hand helically twisted elements or baffles.

BACKGROUND OF THE INVENTION

Motionless mixers are motionless mixing devices generally used to intermix tow viscous fluids. For example, one may wish to mix a thermoset, which consist of a resin and hardener, e.g. epoxy. This can be done by simultaneously passing both the hardener and resin, in their liquid forms, into a conduit of a motionless mixer containing a multiplicity of baffles. As the fluids travel down through the bore of the conduit they are intermixed in stages corresponding to each baffle of the motionless mixer.

In the past, motionless mixers have employed multiple metallic baffle elements. These baffles were easily made but complicated to assemble in series for use in a motionless mixer.

Today, conventional motionless mixers are more typically manufactured from plastic by injecting molding, thereby considerably reducing production costs when made on a large scale basis. Representative examples of such motionless mixers are disclosed in U.S. Pat. Nos. 3,286,992 and 3,953,002 and 3,635,444. The plastic motionless mixers are generally comprised of alternately right- and left-handed helically-curved baffles which are either individually disposed within a bore or are adjacently combined during manufacture to form a single unit insert which is disposed within a bore.

The leading edges employed on these plastic baffles vary in design. In one known design, the two major opposing curved surfaces defining the baffle terminate in and are joined by a planar surface extending from, perpendicular to and lying in a plane normal to the central longitudinal axis of each baffle. A problem encountered in using plastic baffles of this type is the decreased efficiency of the mixing process. Viscous materials such as thermoplastics, resins and various other polymers tend to accumulate and build up on the flat surfaces as they pass over the baffles, thus decreasing the efficiency of the mixing process and oftentimes completely blocking the mixer and stopping fluid flow. The flat leading surfaces also cause a substantial reduction in flow cross-section at the intersection of baffle elements, for example at the intersection of elements of 0.5 inches diameter with a 0.125 inch baffle thickness the available flow area is only 40% of the overall cross-sectional area. This reduction in flow cross-section results in substantial fluid pressure drop.

Each of the baffles of another known arrangement include a knife-like edge at one end (the upstream end) formed by tapering the two curved major opposing surfaces of the baffle towards one another. Motionless mixers of this type, present problems in manufacture. Injection molding a baffle having a knife-like edge formed by tapering a pair of major opposing curved surfaces of the baffle towards one another would be both extremely difficult and costly. This is because more than two mold pieces would be required in order to avoid undercuts. This makes the baffle substantially more costly and difficult to produce.

Accordingly, it is an object of the present invention to provide an improved static mixing device for intermixing a plurality of fluids having varying viscosities and high volumetric ratios.

More specifically, it is an object to provide a static mixing device of relatively economic construction and improved intermixing efficiency.

SUMMARY OF THE INVENTION

According to the invention, there is provided a baffle member for use as a motionless mixer, said baffle member being helically curved symmetrically about a longitudinal axis and being defined by opposed major surfaces extending along said axis from a first end to a second end of said baffle, said major surfaces being connected at said first end by a substantially planar surface extending substantially transversely of said axis and lying in plane substantially parallel to said axis.

Preferably the major surfaces are connected at said first end by a pair of said planar surfaces each extending substantially transversely of said axis and lying in plane substantially parallel to said axis, said pair being disposed in symmetrically opposed relationship extending outwardly from said axis in substantially opposite directions.

The invention also includes a motionless mixer element incorporating a serial coaxial plurality of the baffle members preferably with the baffles being alternatively helically left and right handed wherein the adjacent knife-like edges of adjacent baffles are substantially normal to one another. The invention further includes one-piece motionless mixers incorporating one or more baffles of this type.

A further aspect of the invention involves a motionless mixer comprising a static mixer insert of the invention in combination with a housing. The housing having a passageway through which fluid may flow with the motionless mixer insert located in the passageway.

DESCRIPTION OF THE PREFERRED EMBODIMENT

Figure 1:
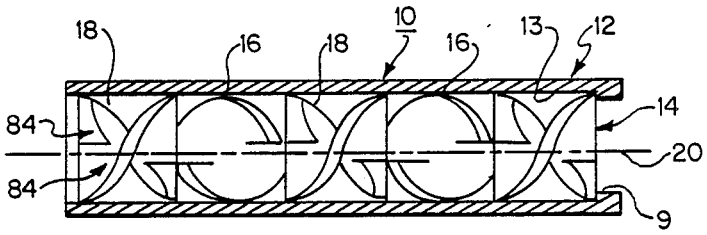
FIG. 1 is a partially sectioned side elevation of a motionless mixer embodying principles of the present invention.
Figure 2:
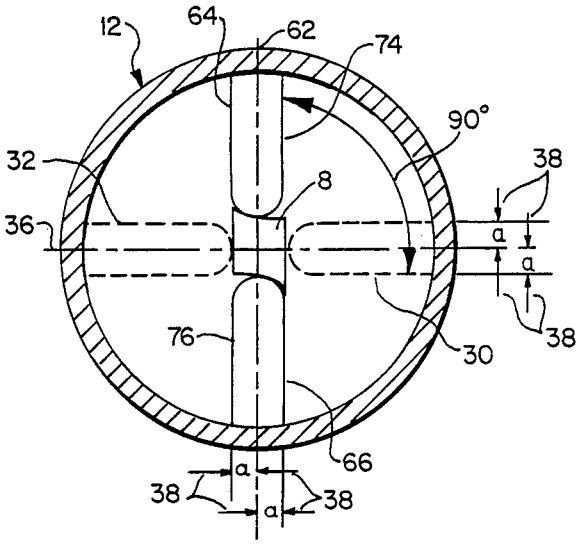
FIG. 2 is an end elevation of the motionless mixer shown in FIG. 1.

Referring to FIGS. 1 and 2 a motionless mixer 10 comprises a tubular housing 12 defining a cylindrical bore 13 through which fluid may flow. A one piece (integrally formed) motionless mixer 14 is disposed in the bore 13, preferably injection molded from a thermoplastic material (e.g. polypropylene). The insert 14 is formed by a first subset of right-handed generally helically curved (twisted) baffles 16 which alternate with a second subset of left-hand generally helically curved (twisted) baffles 18 along a central longitudinal axis 20 of the insert 14 and the bore 13. The insert 14 is a snug fit within the bore 13 and is located by abutment with an annular lip 9 in the tubular housing 12.

As is best seen in FIG. 1, the right-hand curved baffles 16 and left-hand curved baffles 18 of the insert 14 are serially connected directly to one another. The central longitudinal axis of each baffle 16 and 18 is coaxial with the central longitudinal axis 20 of the insert.

Figure 3:
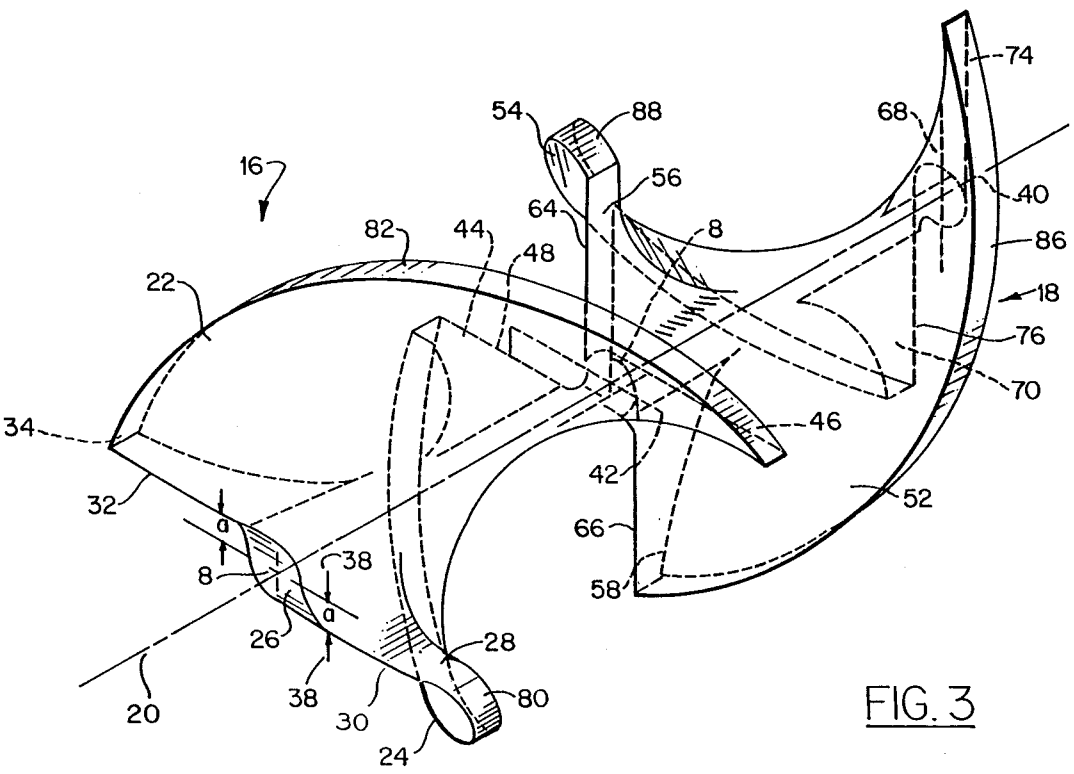
FIG. 3 is a perspective view of a portion of the motionless mixer insert.

A typical right hand baffle 16 and the next adjacent (also typical) left-hand baffle 18 are shown in FIG. 3. Referring first to the right hand-curved baffle 16, there are a pair of substantially symmetric parallel (evenly spaced) opposing major surfaces 22 and 24 helically curved right-handedly along the central longitudinal axis 20 through an angle of approximately 180°. Only a portion of the major surface 24 is visible in FIG. 3. A first, substantially planar surface 28 connects the pair of major surfaces 22 and 24 on the near end 26 of the baffle 16. The intersection of the first planar surface 28 with the major surface 24 forms a first knife-like edge 30 at the near end 26 of the baffle. A second knife-like edge 32 is provided at the near end 26 by the intersection of the major curved surface 22 with a second substantially planar surface 34 (indicated in phantom). Each of the substantially planar surfaces 28 and 34 connects the pair of major surfaces 22 and 24 at the near end 26 of the baffle 16. Each of the first and second substantially planar surfaces 28 and 34 extends both substantially normal to and lies in a plane substantially parallel to the central longitudinal axis. The surfaces 28 and 34 extend on opposite sides of axis 20, are parallel and tangential to a central core 8 which extend along said axis 20 and is common to and joins together all baffles 16 and 18. Hence, each of the first and second planar surfaces 28 and 34 and each of their knife-like edges 30 and 32 are radially displaced from the central longitudinal axis 20 on opposing sides of the central longitudinal axis 20 with the first planar surface 28 being displaced downwardly from a horizontal plane 36 extending through the central longitudinal axis 20 by a distance "a", indicated between the arrows 38. The second substantially planar surface 34 is displaced upwardly from horizontal plane 36 by an identical distance "a". The surfaces 28 and 34 both face plane 36. At the opposite end 40 of the baffle 16 the pair of opposing major curved surfaces 22 and 24 are connected by third and fourth substantially planar surfaces 42 and 44, respectively (both indicated in phantom) similar to but oppositely oriented to surfaces 28 and 34 to define knife edges 46 and 48 oppositely oriented to knife edges 30 and 32. The third and fourth substantially planar surfaces 42 and 44 extend both substantially normal to axis 20 and lie in a plane substantially parallel to the axis 20 and are radially displaced from the axis 20 on opposing sides thereof. The third planar surface 42 is upwardly displaced the distance "a" from the plane 36. The fourth substantially planar surface 44 is downwardly displaced from the plane 36 again by the same distance "a".

Referring again to FIGS. 1 and 3, each end 26 and 40 of each of the two depicted right-hand curved baffles 16 adjoins an end of a left-hand curved baffle 18. One such baffle 18 is depicted in FIG. 3 adjoining end 40 of the right-hand baffle 16. The left-hand baffle 18 has a pair of opposing major surfaces 52 and 54, only a portion of the latter being visible in the view of FIG. 3, helically curved left-handedly along the central axis 20 through an angle of approximately 180°. The baffle 18 is essentially the mirror image of baffle 16 when the image reversal is along the axis 20. The baffles are connected by central core 8 with the planar surfaces 56, 58, 68 and 70 being disposed at an angle, about axis 20 of 90° to the planar surfaces 28, 34, 42 and 44, respectively.

FIG. 2 depicts diagrammatically the leading edges 64 and 66 and the trailing edges 74 and 76 of the leading left-hand element 18. These are each displaced the distance "a" to the left or right of a vertical plane 62 extending through the central longitudinal axis 20. As can also be seen, the edges of each pair of knife edges 64, 66 and 74, 76 (and their forming planar surfaces 56, 58 and 68, 70) are disposed on opposing sides of the vertical plane 62, toward which each of the surfaces 56, 58, 68 and 70 face. Depicted in phantom are the adjoining leading edges 30 and 32 of the following right-hand element 16. As is best seen in FIG. 2, the trailing edges 74 and 76 (and the associated planar surfaces 68 and 70 forming those edges) are angularly displaced around the central longitudinal axis 20 with respect to the two leading edges 30 and 32 (and the associated planar surfaces 28 and 34 forming those edges) at the adjoining end 26 of the adjoining right-hand baffle 16 at approximate 90 degree intervals. It is further noted that edges 64 and 76 and edges 66 and 74 are diametrically opposed to one another across the horizontal plane 36 (see also FIG. 3). The edges and planar surfaces of baffle 16 are similarly diametrically opposed and displaced with respect to one another.

Referring again to FIG. 3 the baffle 16 includes a pair of circumferential opposing minor surfaces 80 and 82, generally right-hand helically curved along the central axis 20, which are formed to sit flush against an inner wall of the housing 14 forming the cylindrical bore 13. The left-hand baffle 18 includes a similarly oppositely helically curved pair of minor opposing curved surfaces 86 and 88.

In operation, a pair of fluids are introduced into the device 10 onto the opposing major curved surfaces of the lead baffle. This is indicated diagrammatically in FIG. 1 assuming the furthest left left-hand curved baffle 18 is the lead baffle of the insert 14. The pair of fluids are indicated by arrows 84. The alternating helical motion imparted to the fluids with repeated divisions and recombinations of different portions and velocities thereof by the subsequent baffles creates enhanced intermixing. The fluid path within the element is divided between two symmetrical semicircular passageways. Near the end of the element, the passageways alter into assymmetric passageways, having been shifted around the center core in a cartwheel fashion. FIG. 2, illustrates the cartwheel geometry, such that offsetting of the pair of leading edges of each of the right-hand baffles 16 and left-hand baffles 18 with the pair of trailing edges of the adjacent left-hand baffle 18 or right-hand baffle 16, respectively.

In addition, knife edging of the leading or leading and trailing edges of the baffles 16 and 18 increases the cross-sectional area available for flow at the junction of adjacent baffles and creates velocity gradients that increase the fluid area available for splitting the flow. Knife edging also eliminates the tendency of fluids to accumulate on the edges of the baffles 16 and 18, which would decrease mixing efficiency and possibly completely block fluid flow through the mixer 10. In addition offsetting the knife edges enable the motionless mixer insert 14 to be injection molded using only a pair of mold halves. This simplifies considerably the injection molding of the insert and minimizes its cost.

Although the invention has been described with respect to a preferred embodiment motionless mixer incorporating a one-piece plastic molded insert, individual baffles of the described geometry can be positioned within a passageway to form a motionless mixer enjoying at least some of the advantages of the disclosed preferred embodiment. Moreover, although the baffles 16 and 18 of the preferred embodiment insert are immediately adjoining one another, spacers could be provided between the baffles along the central longitudinal axis 20 of the insert 14 to coaxially separate the adjoining trailing edges and leading edges of adjoining baffles pairs. Similarly, although knife-like edges are provided at the leading and trailing edges of each of the baffles of the preferred embodiment, some advantages of the subject invention can be enjoyed by employing knife edges on only one of the leading and trailing sides of each baffle or on less than all the baffles of an insert or in a motionless mixer.

From the foregoing description, it can be seen that the present invention provides an easily manufactured and superior performing motionless mixer. It will be recognized that although certain modifications have been suggested, other changes could be made to the above-described invention without departing from the broad inventive concepts thereof. It is understood, therefore, that the invention is not limited to the particular embodiment(s) disclosed, but is intended to cover any modifications which are within the scope and spirit of the invention as defined by the appended claims.

I claim:

1. A motionless mixer baffle member having opposed major surfaces and first and second ends, said baffle member being helically twisted symmetrically about a longitudinal axis and being defined by said opposed major surfaces extending along said axis from said first end to said second end of said baffle, said major surfaces being connected together at said first end by a substantially planar surface extending substantially transversely of said axis and lying in a plane substantially parallel to said axis.

2. A baffle member according to claim 1 wherein said major surfaces are connected at said first end by a pair of said planar surfaces each extending substantially transversely of said axis and lying in plane substantially parallel to said axis, said pair being disposed in symmetrically opposed relationship extending outwardly from said axis in substantially opposite directions.

3. A baffle member according to claim 2 wherein said major surfaces are connected at said second end by a pair of planar surfaces in like manner to the said connection at said first end.

4. A baffle member according to claim 2 wherein the planar surfaces with the major surfaces define a pair of knife edges at said first end, said pair of knife edges being disposed in symmetrically opposed relationship extending outwardly from said axis in substantially opposite directions substantially in a plane which is substantially normal to said axis.

5. A baffle member according to claim 3 wherein the planar surfaces with the major surfaces at each of the first end and the second end define a pair of knife edges, each said pair of knife edges being disposed in symmetrically opposed relationship extending outwardly from said axis in substantially opposite directions substantially in a plane which is substantially normal to said axis.

6. A baffle member according to claim 2 wherein said member defines a central core extending symmetrically about and along said axis with said pair of planar surfaces extending tangentially of said core with each said surface facing a plane passing through said axis and parallel to said planes parallel to said axis.

7. A baffle member according to claim 6 wherein the helical curve subtends an angle of approximately 180° about said axis from said first end to said second end.

8. A combination of the baffle member according to claim 2 with at least one other such baffle member serially arranged along said axis and alternately of oppositely handed helical twist with adjacent members being oriented approximately 90° apart relative to one another about said axis to form a motionless mixer.

9. A combination of the baffle member according to claim 3 with at least one other such baffle member serially arranged along said axis and alternately of oppositely handed helical twist with adjacent members being oriented approximately 90° apart relative to one another about said axis to form a motionless mixer.

10. A combination of the baffle member according to claim 4 with at least one other such baffle member serially arranged along said axis and alternately of oppositely handed helical twist with adjacent members being oriented approximately 90° apart relative to one another about said axis to form a motionless mixer.

11. A combination of the baffle member according to claim 5 with at least one other such baffle member serially arranged along said axis and alternately of oppositely handed helical twist with adjacent members being oriented approximately 90° apart relative to one another about said axis to form a motionless mixer.

12. A combination of the baffle member according to claim 6 with at least one other such baffle member serially arranged along said axis and alternately of oppositely handed helical twist with adjacent members being oriented approximately 90° apart relative to one another about said axis to form a motionless mixer.

13. A combination of the baffle member according to claim 7 with at least one other such baffle member serially arranged along said axis and alternately of oppositely handed helical twist with adjacent members being oriented approximately 90° apart relative to one another about said axis to form a motionless mixer.

14. The combination according to claim 8 and a cylindrical tube having an inner surface defining a cylindrical bore, each baffle member of said motionless mixer being in intimate contact with said inner surface from its first end to its second end to define two separate substantially equally sized helically curved passages of substantially semi-circular cross-section.

15. The combination according to claim 9 and a cylindrical tube having an inner surface defining a cylindrical bore, each baffle member of said motionless member being in intimate contact with said inner surface from its first end to its second end to define two separate substantially equally sized helically curved passages of substantially semi-circular cross-section.

16. The combination according to claim 10 and a cylindrical tube having an inner surface defining a cylindrical bore, each baffle member of said motionless mixer being in intimate contact with said inner surface from its first end to its second end to define two separate substantially equally sized helically curved passages of substantially semi-circular cross-section.

17. The combination according to claim 11 and a cylindrical tube having an inner surface defining a cylindrical bore, each baffle member of said motionless mixer being in intimate contact with said inner surface from its first end to its second end to define two separate substantially equally sized helically curved passages of substantially semi-circular cross-section.

18. The combination according to claim 12 and a cylindrical tube having an inner surface defining a cylindrical bore, each baffle member of said motionless mixer being in intimate contact with said inner surface from its first end to its second end to define two separate substantially equally sized helically curved passages of substantially semi-circular cross-section.

19. The combination according to claim 13 and a cylindrical tube having an inner surface defining a cylindrical bore, each baffle member of said motionless mixer being in intimate contact with said inner surface from its first end to its second end to define two separate substantially equally sized helically curved passages of substantially semi-circular cross-section.

20. The combination according to claim 8 wherein the plurality of members is integral.

* * * * *